United States Patent [19]

Wollner

[11] Patent Number: 4,628,835

[45] Date of Patent: Dec. 16, 1986

[54] WASTE FLUID INCINERATOR HAVING HEAT RECOVERY MEANS

[75] Inventor: Karl E. Wollner, Falkenweg, Fed. Rep. of Germany

[73] Assignee: Vapor Corporation, Chicago, Ill.

[21] Appl. No.: 656,084

[22] Filed: Sep. 28, 1984

[51] Int. Cl.[4] ..... F23G 7/04

[52] U.S. Cl. ..... 110/238; 110/346; 431/284

[58] Field of Search ..... 110/238, 346; 431/284; 239/423, 424

[56] References Cited

U.S. PATENT DOCUMENTS 3,822,654 7/1974 Ghelfi ..... 110/238 X 4,094,625 6/1978 Wang et al. ..... 431/284 X

*Primary Examiner*—Edward G. Favors

*Attorney, Agent, or Firm*—Francis J. Lidd

[57] ABSTRACT

An incinerator particularly suited for disposal of waste fluids containing undesirable chemicals and hydrocarbons including sodium cyanide. A novel dual fuel combustion system wherein the waste fluid is injected intermediate an inner high temperature flame and an outer somewhat lower temperature flame, provides a "blanket" combustion pattern. The blanket combustion pattern provides increased recirculation in the combustion chamber, thereby increasing residence time and ensuring complete destruction of the undesirable waste hydrocarbon.

6 Claims, 7 Drawing Figures

WASTE FLUID INCINERATOR HAVING HEAT RECOVERY MEANS

CROSS REFERENCE TO RELATED APPLICATIONS

In my co-pending application bearing the Ser. No. 656,098, titled "Air Preheater for a Compact Boiler" filed on Sept. 28, 1984, a combustion air preheater suitable for use in the waste fluid incinerator disclosed herein, is disclosed.

BACKGROUND OF THE INVENTION

Incineration of liquid waste materials particularly undesirable hydrocarbons, is well known in industry today. Use of incineration in disposing of obnoxious and/or hazardous liquid wastes is greatly increased due to required compliance with recently adopted laws protecting the environment from storage and/or dumping of these materials. Environmental protection laws further require close control of amounts of undesirable chemicals and/or hydrocarbons discharged into the atmosphere, hence there is substantial need for waste fluid incinerators which can achieve zero or very low amounts of the undesirable waste material in exhaust emissions.

Typical presently used fluid incinerators are disclosed in U.S. Pat. Nos. 3,834,855, 3,861,330, and 4,372,226. These units, while dealing with the process of waste fluid disposal through combustion and/or incineration, do not provide controllable means for ensuring that the incinerated waste fluid is completely eliminated from stack emissions.

Waste fluids typically include combustible hydrocarbons and other chemicals. An additional and more difficult incineration problem is presented by water soluble waste compounds, since the concentration of the chemicals and the characteristics of the water carrier substantially alter any associated combustion process.

In order to successfully incinerate water soluble wastes, applicant has discovered that establishing a peripherally adjacent blanket combustion system wherein a curtain of liquid waste is injected adjacent to combusting fuel provides a means for controlling residence time and temperature within the incinerator combustion chamber, thereby ensuring complete breakdown of the undesirable chemicals contained in order to meet emission standards established by law.

Therefore, it is an object of this invention to provide a waste fluid incinerator having controlled combustion processes thereby minimizing quantities of the objectionable hydrocarbon and nitrogen oxide (NOX) contained in gaseous atmospheric emissions from the incinerator.

It is an additional object of this invention to provide a waste fluid incinerator which ensures essentially complete breakdown or destruction of the undesirable component including those dissolved in liquid water.

It is a further object of this invention to provide a waste fluid incinerator having a combustor design which injects waste fluid intermediate the combustion envelopes of liquid and gaseous fuels.

It is an additional object of this invention to provide a waste fluid incinerator having a blanket combustion system wherein the residence time and temperature of combustion gases are controlled to achieve predetermined emissions.

It is a further object of this invention to provide a waste fluid incinerator having a combustion system which reduces quantities of the undesirable fluids in the incinerator exhaust thereby meeting legislated emission standards, and at the same time, recovering substantial amounts of heat from said exhaust gases.

SUMMARY OF THE INVENTION

As many of the operating details and system functions of the waste fluid incinerator/boiler disclosed herein are similar to those contained in U.S. Pat. Nos. 3,226,257 and 3,282,257, disclosing and claiming a combustor and fluid heater, and U.S. Pat. No. 4,141,505, entitled "Heavy Fuel Oil Nozzle", the following disclosure will concern essential details of the novel combustion, burner, and heat recovery systems directly related to the invention disclosed. Therefore, as those skilled in the art will readily find any further detail relative to ancillary systems disclosed herein, U.S. Pat. Nos. 3,226,038, 3,282,257, 4,422,387, and 4,141,505 are hereby incorporated by reference into this specification.

The waste fluid incinerator/boiler disclosed herein incorporates a combustion system including a dual fuel type, establishing outer and inner combustion patterns. Thereby sandwiching a curtain of the injected waste fluid between an outer envelope and inner core of combustion fuels or establishing a peripherally adjacent combustion system to said injected waste fluid.

Typically, the inner fuel is atomized oil, and the outer fuel is natural gas. Those skilled in the combustion arts however, will readily understand that many other fuel combinations might be used as well. These would include natural gas as an inner fuel, and law BTU gases, such as carbon monoxide, as an outer fuel. Applicant has discovered that combustor design, through the use of the above mentioned "sandwich" or blanket combustion systems, provides substantially increased residence time of the centrally injected waste fluid, thereby increasing the probability that waste fluid will be totally incinerated. Further, the blanket system provides improved control of the incinerator combustor internal temperatures. Adjustment of incinerator parameters including inner and outer fuel inputs, combustion gas temperatures, quantities of incinerated waste fluid and combustion air provides a novel and convenient means for controlling temperature of the incinerating waste fluid/material. Typically, measurement of the incinerator process temperature and emission content continuously controls these parameters.

Alternate use of the "blanket" system wherein a waste fluid layer surrounds or is surrounded by combusting fuel is also contemplated by applicant's discovery and exemplified by the disclosed structure. A typical blanket embodiment would employ applicant's novel injector so as to generate an inner core or outer envelope of combustion products.

An additional feature of the disclosed waste fluid incinerator/boiler is heat recovery from the fuels utilized to incinerate liquid wastes.

DETAILED DESCRIPTION OF THE INVENTION

Figure 1:
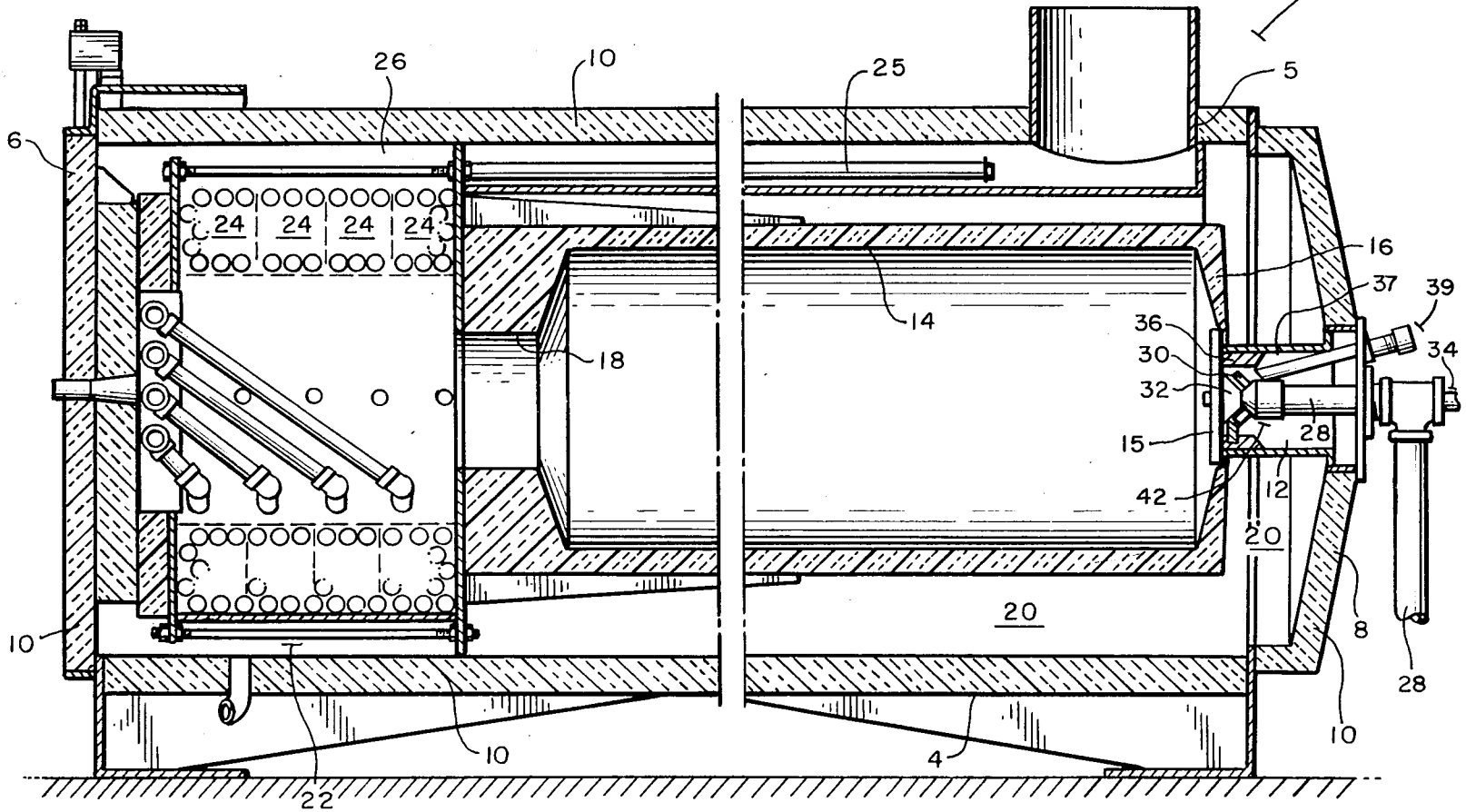
FIG. 1 is a cross-section of the incinerator boiler disclosed, particularly showing the burner and combustor assemblies, the combustion chamber, heat exchanger coils, and the stack combustion air preheater.

With particular reference to FIG. 1, there is disclosed a waste fluid incinerator/boiler assembly 2, having an outer shell 4, a combustor supporting end 8. Opposite the combustor end is a cover 6, providing closure for the heat exchange assembly. Insulation material 10 forms a part of and lines the entire outer shell. Internal of the outer shell is a cylindrical combustion chamber 14, having the burner assembly 12 at one end, and the combustor choke 18, an outlet for combustion gases at the opposite end. Temperature of the incineration process is measured by a sensor 13, located so as to provide information relating to recirculation of combusting gases, and an indication of increased residence time. Typically, control of the process includes continuous temperature measurement and may include continuous adjustment of input quantities, such as fuel, combustion air, and waste fluid flows. The burner assembly 12 extends inwardly from the outer combustion end 8, so as to enter the combustion chamber burner inlet 16 in the combustion chamber inlet end 15, so as to allow entrance of primary air, secondary air, and the dual fuel/fluid inputs to the "blanket" burner.

Adjacent the combustion chamber choke outlet 18, and in fluid communication therewith, is the heat exchanger assembly 22. The heat exchanger assembly is constructed similarly to that disclosed and claimed in above mentioned U.S. Pat. No. 3,226,038, now incorporated by reference, and provides a radial path for combustion gases exiting the choke 18, and passing through the row of coils 24 to reach the annular coil exhaust passage 26. Concentrically abutting the coil exhaust passage 26, and in fluid communication therewith is the combustion air preheater, and a semi-annular exhaust gas plenum 27. The combustion air preheater is a heat exchanger arranged to transfer heat from exhaust gases passing through the coil assemblies 24, and travelling to the exhaust stack 5 via the exhaust gas plenum 27. Combustion air from a combustion air blower (not shown) pressurizing the annular combustion chamber primary air plenum 20, passes across the combustion air preheater 25, thereby providing increased combustion air temperature flowing around the outer surface of the combustor 14, and entering the combustion process via primary air passage 38, and secondary air flow control vanes 40 of the burner assembly 12.

The burner assembly 12 of the preferred embodiment disclosed further consists of a burner combustion gas inlet conduit 28, fluid communicating with a plurality of combustion gas nozzles 30, located on an extension of the conduit 28, located essentially concentric and internal of the burner assembly primary air inlet chamber 37. The burner assembly inlet shell further utilizes an annular refractory portion 36, surrounding the portion of the burner assembly located just within the combustion end of the combustion chamber 16.

Also located in the primary air inlet chamber 37 is a flame sensor assembly 39, for detecting the presence of flame within the boiler.

Figure 3:
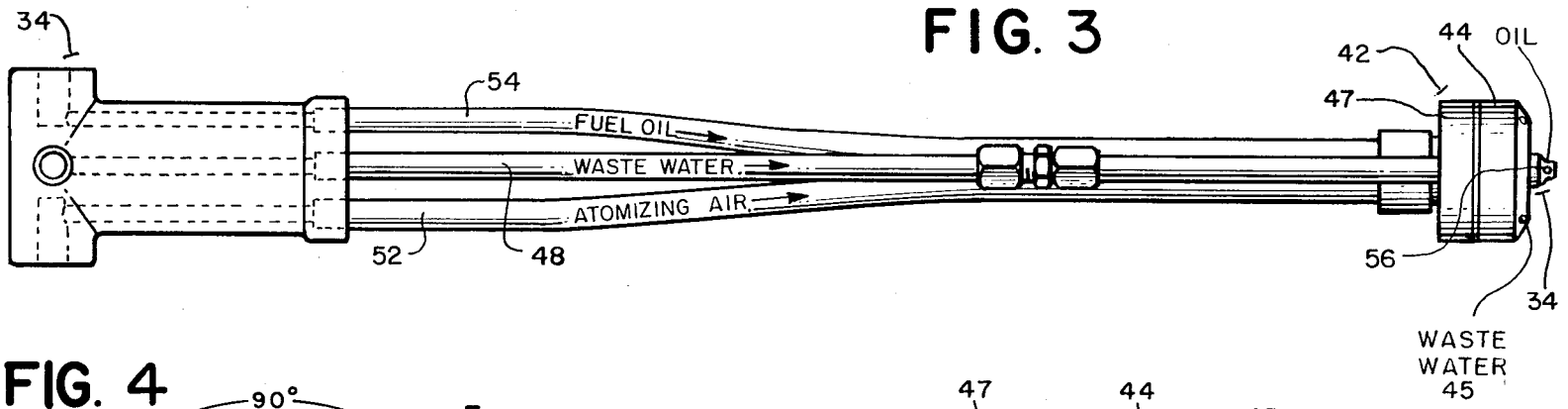
FIG. 3 is an additionally enlarged detail of the waste fluid/liquid fuel injector nozzle assembly of the "blanket" burner.
Figure 5:
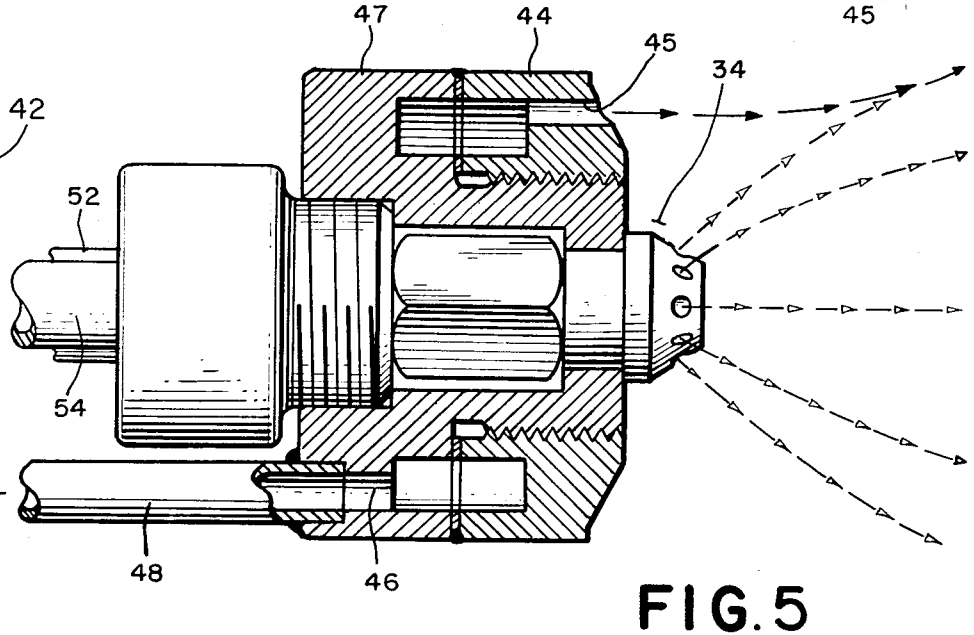
FIG. 5 is a cross-sectional detail of the oil fuel waste material injector nozzle.
Figure 4:
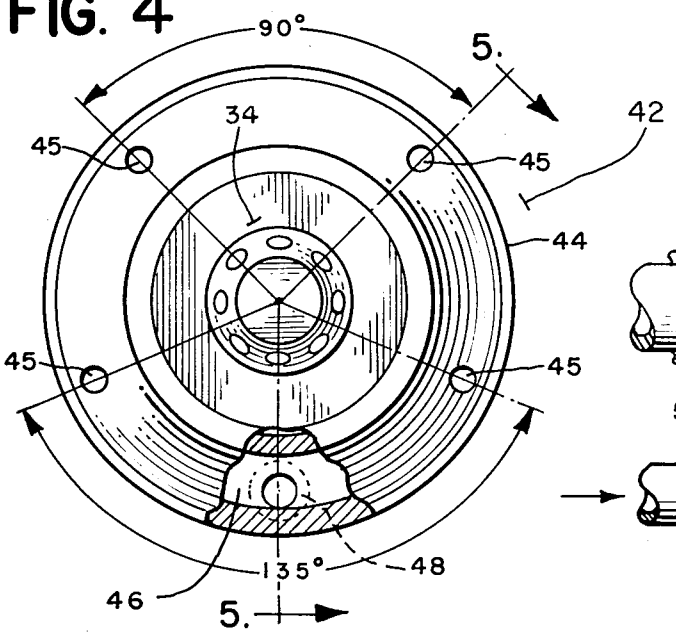
FIG. 4 is a front, partially sectioned view of the waste fluid nozzle.

Extending internal of and concentrically longitudinal with the horizontal portion of the gaseous fuel conduit 28 is the burner compound combustion fuel/waste fluid nozzle assembly 34. As disclosed, the compound nozzle utilizes atomized oil to establish an inner flame however, other liquid fuels and gases can be used as well. With particular reference to FIGS. 3 and 4, the water-/oil nozzle 34 utilizes a nozzle assembly 42, having oil exit orifices 56 internally concentric of waste water orifices 45. With regard to detailed operation of the oil nozzle, those skilled in the art will find satisfactory discussion of the operation of this system in the above mentioned, and incorporated by reference U.S. Pat. No. 4,141,505.

Supply of fuel oil, waste water of fluid carrying the chemical or other material to be incinerated, and atomizing air, are provided to the nozzle assembly 42 by conduits 54, 48, and 52, respectively (reference FIG. 3). As disclosed, a curtain of waste material is injected circumferentially in the nozzle distribution header 47, the injection angle with respect to the oil nozzle axis being such that injected waste material does not substantially interfere with the combusting oil.

Figure 2:
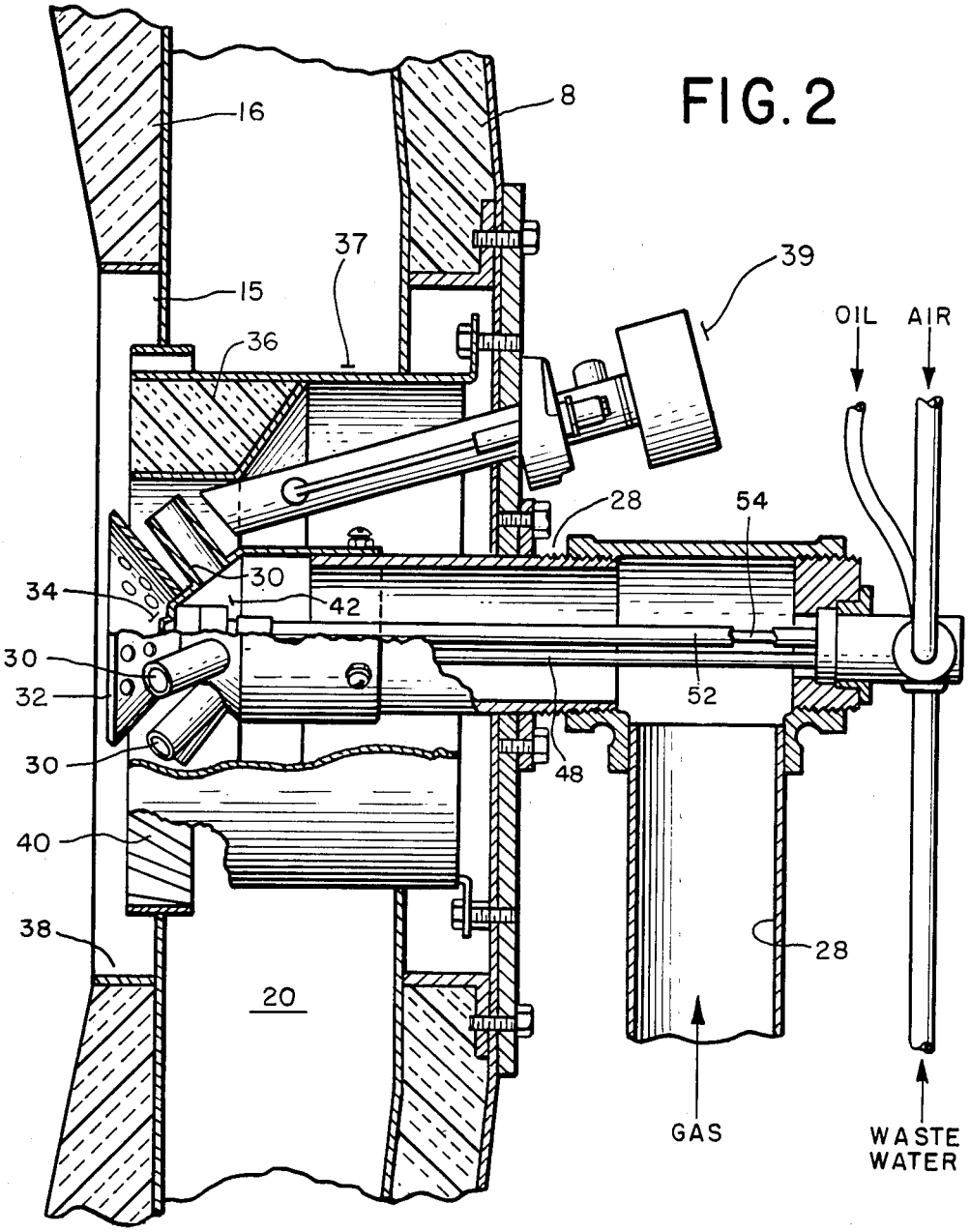
FIG. 2 is an enlarged cross-section of the burner assembly of FIG. 1, particularly showing location of the "blanket" oil/gas burner, along with associated primary and secondary air inlets.

As indicated above, in particular reference to FIG. 2, surrounding the liquid fuel waste fluid injector assembly 42 are a plurality of combustion gas nozzles 30. Intermediate the nozzles 30 and concentric nozzle waste fluid orifice plate 44 and outer nozzle waste fluid orifices 45, is a combustion gas flame spreader or cone 32. Additional discussion of the operation of this cone will be found in U.S. Pat. No. 3,226,038, incorporated by reference.

With reference to FIG. 2, surrounding the gaseous fuel nozzle 30 and flame spreader 32 is a circumferential set of secondary air flow control vanes 40, for providing predetermined "swirl" of primary combustion air entering the combustion chamber from the primary air plenum 20.

Figure 6:
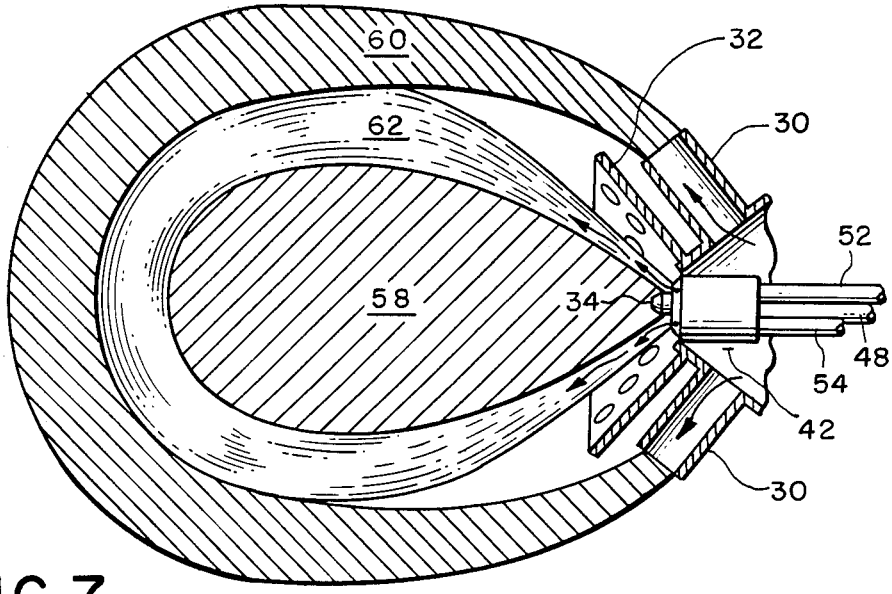
FIG. 6 is a semi-schematic/pictorial representation of the "blanket" combustion system flame patterns of the invention.
Figure 7:
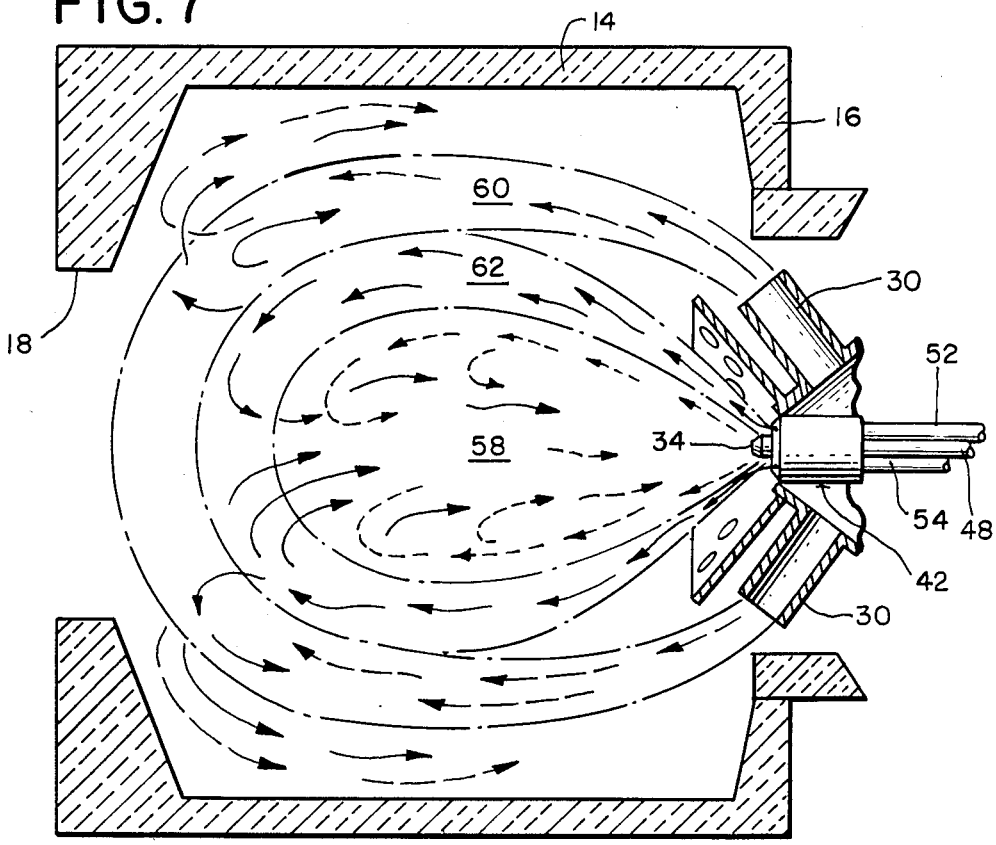
FIG. 7 is a sectional view of the incinerator combustion chamber, particularly showing fuel/waste material recirculation.

In operation, combustion gas, liquid fuel, and waste fluid are simultaneously applied to the burner assembly 12. After ignition, flame patterns internal of the combustion chamber 14 are established as shown in FIGS. 6 and 7. Applicant has discovered that utilizing the structure disclosed above, and utilizing typical flow rates, the combustion pattern of FIG. 6 establishes the "blanket" flame pattern. As shown, liquid fuel exiting fuel orifices 6, establish a high temperature flame zone 58. Similarly, combusting gas exiting the gas nozzle 30 establishes a gas flame zone 60, as shown. Intermediate injection of the liquid waste via discharge nozzles 45 at a predetermined rate, establish a waste liquid flame zone 62, as shown in FIGS. 6 and 7. Applicant's discovery further includes establishing recirculation zones adjacent the above mentioned liquid fuel and gaseous fuel flow patterns wherein interaction provides increased recirculation adjacent the peripheral walls of the combustion chamber 14. As shown, the gaseous fuel recirculation zone 61 and liquid fuel oil flame recirculation zone 59, interact to return the now mixed products of combustion, thereby passing through and mixing with the injected waste fluid roughly in the portion 68 of the combustion system, as shown. Applicant's discovery indicates that these recirculation zones are extremely important in increasing the retention size of the waste fluid incinerator combustion system, and further provide for complete incineration of the injected waste liquid. Products of combustion obtained by test of a specific incinerator using flow rates indicated below, have resulted in the following actual stack emission analysis.

| | Actual | Permissible |
|---|---|---|
| $NH_3$ | .4 ppm | 1.0 ppm |
| CN | .00 ppm | .00 ppm |
| $NO_X$ | 185 ppm | 300 ppm |
| $O_2$ | 3-4% | 2-5% |
| Combustion Chamber: | | |
| 102 Inches long × 36 Inches (Diameter) | | |
| Combustion Chamber Temp. | 1545° F. | 1470-1650° F. |
| Waste Fluid Flow: | | |
| 132 Gallons/Hr (.1% $HC_N$ - 84% water by Volume) | | |

Thus, it is apparent that there has been provided in accordance with the invention, a waste fluid incinerator utilizing a novel dual fuel "blanket" combustion system that fully satisfies the objects, aims and advantages set forth above. While the waste fluid incinerator disclosed has been in conjunction with a specific embodiment thereof, it is evident that many alternatives, modifications, and variations will be apparent to those skilled in the combustion arts, on review of the foregoing description. Accordingly, the invention disclosed is intended to embrace all such alternatives, modifications, and variations as fall within the spirit and broad scope of the appended claims.

Therefore, I claim:

1. A method of incinerating waste fluid comprising the steps of;

establishing an outer envelope of combusting hydrocarbon fuel;

establishing an inner zone of combusting fuel at a temperature somewhat higher than said outer envelope;

injecting a predetermined amount of waste liquid intermediate said outer envelope and inner zone;

establishing recirculation zones in a preselected portion of said outer envelope, inner zone, and waste liquid;

mixing and recirculating said injected waste liquid, combusting outer envelope hydrocarbons, and combusting inner hydrocarbons, thereby generating combustion products; and increasing combustion product retention time within the outer envelope and inner zone.

2. Apparatus for incinerating liquid wastes by interaction with combusting hydrocarbons, the improvement comprising;

an essentially cylindrical combustion chamber having a predetermined length and diameter;

means admitting excess combustion air into said chamber;

means for admitting gaseous hydrocarbon fuel/air mixture for generating an outer envelope of combusting gases adjacent to said chamber cylindrical walls;

means admitting atomized liquid fuel for generating a central core of combusting hydrocarbons, essentially coaxial said outer envelope;

means injecting atomized liquid waste intermediate said envelope and central core;

means internal said chamber generating recirculating zones of said core and envelope combustion products, said zones further passing through said atomized liquid waste, for increasing liquid waste residence time in said chamber;

whereby liquid waste is heated to a predetermined temperature determined by said envelope and core for a predetermined time interval.

3. The apparatus of claims 2 wherein said liquid waste injecting means and liquid fuel admitting means comprise an atomizing nozzle and said liquid waste and liquid fuel is introduced to said combustion chamber at one end.

4. The apparatus of claim 2 further comprising;

a generally cylindrical compound fuel and waste fluid injector having first and second ends;

means admitting fuel, atomizing air, and liquid waste in said first end;

orifice means in said second end where said intersecting and fuel admitting means comprises;

a plurality of outer passages in a generally circular configuration coaxial said injector cylinder, each terminating in a second end outer orifice;

a plurality of inner passages concentric said injector cylinder each terminating in a second end inner orifice;

means in said injector fluid communicating said liquid water, atomizing air, and outer passages;

means in said injector fluid communicating said fuel and inner passages.

5. The injector of claim 4 wherein said orifice means includes four outer orifices radially spaced in a 135°, 67.5°, 90V, and 67.5° pattern.

6. The injector of claim 4 further including means fluid communicating said atomizing air and inner passages.

* * * * *